US011293451B2

(12) United States Patent
Beers et al.

(10) Patent No.: US 11,293,451 B2
(45) Date of Patent: Apr. 5, 2022

(54) COATING FOR COMPRESSOR OUTLET HOUSING

(71) Applicant: Hamilton Sundstrand Corporation, Charlotte, NC (US)

(72) Inventors: Craig M. Beers, Wethersfield, CT (US); Seth E. Rosen, Middletown, CT (US); Brent J. Merritt, Southwick, MA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 156 days.

(21) Appl. No.: 16/590,450

(22) Filed: Oct. 2, 2019

(65) Prior Publication Data

US 2021/0102549 A1 Apr. 8, 2021

(51) Int. Cl.
*F04D 29/28* (2006.01)
*C23C 30/00* (2006.01)

(52) U.S. Cl.
CPC ..... *F04D 29/289* (2013.01); *C23C 30/005* (2013.01); *F04D 29/284* (2013.01)

(58) Field of Classification Search
CPC .... F04D 29/289; F04D 29/284; F04D 29/023; F04D 29/4206; F05D 2300/611; F05D 2220/10; F05D 2260/95; F05D 2230/90; C23C 30/005
See application file for complete search history.

(56) References Cited

U.S. PATENT DOCUMENTS

| | | | | |
|---|---|---|---|---|
| 8,790,789 | B2 * | 7/2014 | Ramgopal | C23C 4/06 428/546 |
| 9,181,959 | B2 * | 11/2015 | Rosen | F04D 29/422 |
| 9,243,643 | B2 * | 1/2016 | Beers | F04D 29/4206 |
| 9,656,343 | B2 * | 5/2017 | Beers | B23K 33/004 |
| 10,072,512 | B2 * | 9/2018 | Beers | F01D 9/041 |
| 10,072,519 | B2 * | 9/2018 | Beers | F01D 17/165 |
| 10,087,760 | B2 * | 10/2018 | Beers | F01D 5/005 |
| 10,132,327 | B2 * | 11/2018 | Beers | B64D 13/06 |
| 10,214,804 | B2 * | 2/2019 | Beers | B22D 25/02 |
| 10,294,962 | B2 * | 5/2019 | Strock | F04D 29/526 |

(Continued)

FOREIGN PATENT DOCUMENTS

| | | | | |
|---|---|---|---|---|
| EP | 1808576 | A1 * | 7/2007 | F01D 5/02 |
| WO | 2006/126993 | A1 | 11/2006 | |
| WO | WO-2006126993 | A1 * | 11/2006 | F04D 29/289 |

OTHER PUBLICATIONS

European Search Report for EP Application No. 19214395.6 dated Jun. 18, 2020.

*Primary Examiner* — Brian P Wolcott
(74) *Attorney, Agent, or Firm* — Carlson, Gaskey & Olds, P.C.

(57) ABSTRACT

A compressor outlet housing with a housing body has a volute and a radially inwardly extending wall extending from a radially inner surface of the volute. The radially inwardly extending wall extends inwardly to a ledge. A radially inwardly extending web extends to a bearing support. A fillet which will face an impeller when the compressor outlet housing is mounted in a compressor. The fillet connects the ledge to the web. An erosion resistant coating is formed on the fillet. In addition, a compressor incorporating the compressor housing is disclosed as is a method of repairing a compressor outlet housing.

13 Claims, 4 Drawing Sheets

(56) References Cited

U.S. PATENT DOCUMENTS

| | | | | |
|---|---|---|---|---|
| 10,441,968 | B2 * | 10/2019 | Barth | B05D 7/50 |
| 11,092,019 | B2 * | 8/2021 | Srinivasan | F01D 5/288 |
| 2009/0176110 | A1 * | 7/2009 | Pabla | C23C 4/02<br>428/450 |
| 2017/0204873 | A1 | 7/2017 | Beers et al. | |
| 2019/0085865 | A1 * | 3/2019 | Strock | F01D 11/122 |

* cited by examiner

COATING FOR COMPRESSOR OUTLET HOUSING

BACKGROUND

This application relates to a compressor housing for a radial compressor.

Compressors are utilized in any number of applications. One compressor application provides air to an air cycle machine on an aircraft. In known compressors, a compressor outlet housing has a volute, which provides a changing flow cross-sectional area downstream of a compressor impeller. The outlet further has a bearing support which mounts a bearing on the housing to support a shaft driving the impeller. An outer ledge provides a support surface for a portion of the impeller. The bearing support is connected to the outer ledge through a radially outwardly extending web.

The web is provided as a solid portion and the overall compressor housing is cast and then machined to a complex shape.

As might be appreciated, the outlet housing sees a number of challenges in operation and can be damaged.

SUMMARY

A compressor outlet housing with a housing body has a volute and a radially inwardly extending wall extending from a radially inner surface of the volute. The radially inwardly extending wall extends inwardly to a ledge. A radially inwardly extending web extends to a bearing support. A fillet which will face an impeller when the compressor outlet housing is mounted in a compressor. The fillet connects the ledge to the web. An erosion resistant coating is formed on the fillet.

In addition, a compressor incorporating the compressor housing is disclosed as is a method of replacing a compressor outlet housing.

These and other features may be best understood from the following drawings and specification.

DETAILED DESCRIPTION

Figures 1A, 1B:
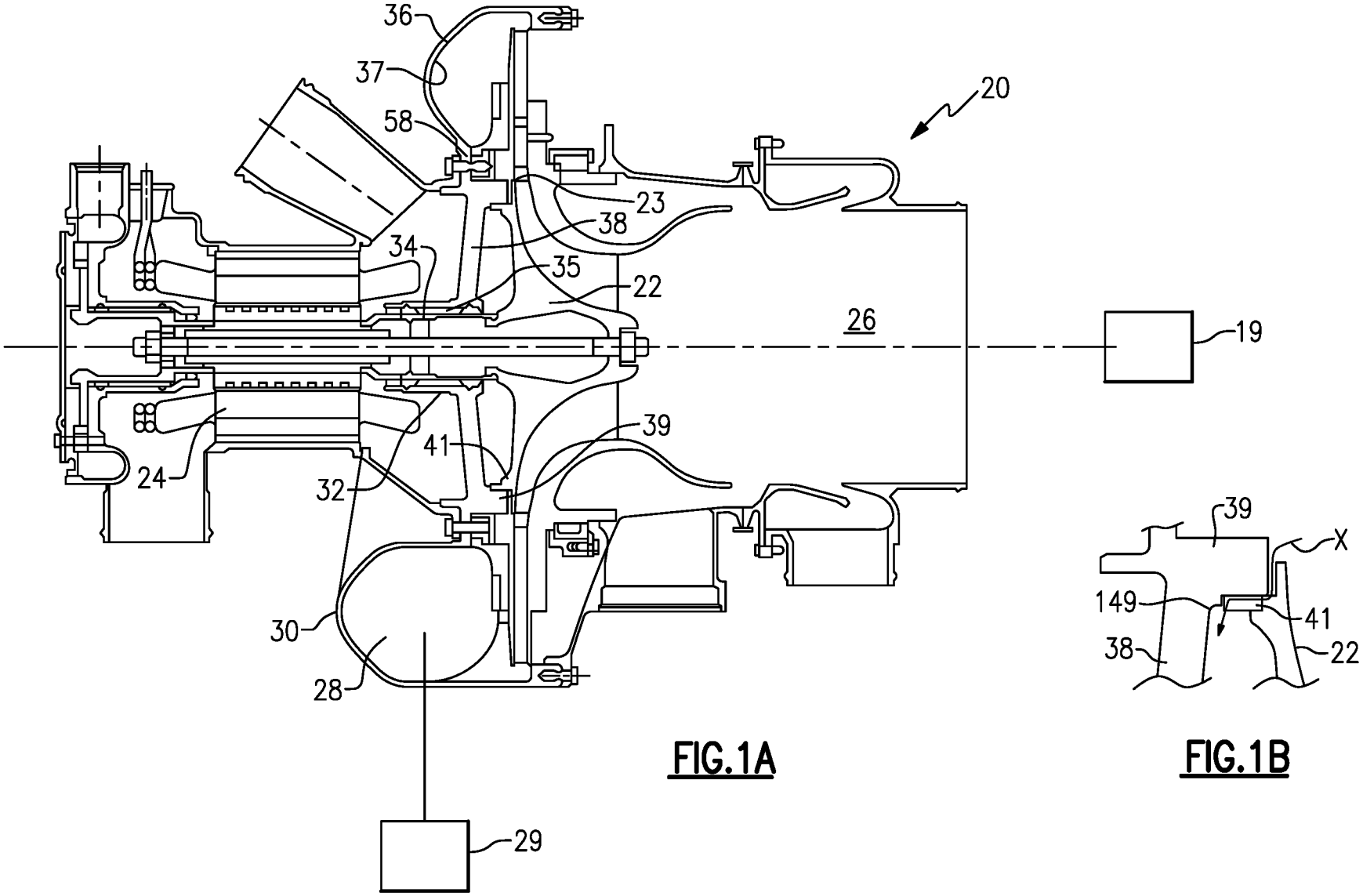
FIG. 1A shows a compressor.
FIG. 1B shows a concern with the compressor.

FIG. 1A shows a compressor 20 including an impeller 22 driven by a motor 24 through a shaft 34. An inlet 26 supplies air to the impeller 22 and the air is compressed and delivered to an outlet 28. An outlet housing 30 includes a volute 36 having an inner face 37 defining a flow passage, which changes across a cross-sectional area between an outlet 23 of the impeller 22 and an outlet 28 of the housing. Outlet 28 is connected to an air cycle machine 29 which may be utilized in an aircraft application.

In this embodiment, the inlet 26 is connected to a RAM air inlet 19. This will supply air to the inlet 26 from a location outside of an aircraft incorporating the compressor 20. The air cycle machine 29 delivers air for use on that aircraft, such as providing air for an aircraft cabin.

As can be seen, the outlet housing 30 includes a bearing support 32, which supports an outer surface of the shaft 34 through bearings 35. A web 38 connects the bearing support 32 to a ledge 39. The ledge 39 connects the web 38 to a volute 36 through wall 58.

As shown, seal teeth 41 are formed on the back of the compressor impeller 22 and positioned adjacent a softer material on the compressor outlet housing 30. The seal teeth etch a groove into this portion of the housing to minimize leakage.

The compressor outlet housing 30 is formed of relatively soft aluminum. As shown in FIG. 1B, although the seal teeth 41 do limit leakage, there is leakage air X from an area downstream of the impeller 22 across the seal 41 and against the compressor outlet housing 30. In particular, the air is directed against a fillet 149, which connects the ledge 39 to the web 38.

Since the air entering the inlet 26 is from outside of the aircraft, it may contain impurities. The air hits the ledge 39 and web 38 at relatively high velocity. Thus, erosion damage can occur to the soft aluminum.

Figure 2:
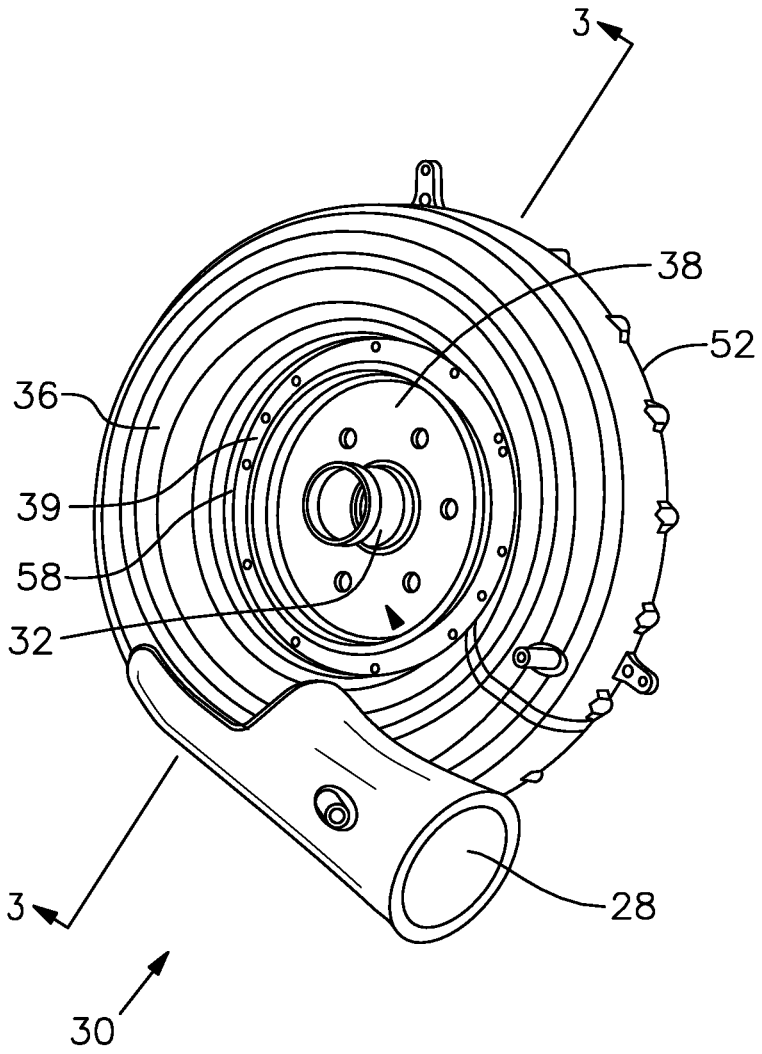
FIG. 2 shows a compressor outlet housing.

FIG. 2 shows the compressor outlet housing 30. Bearing support 32 is connected by the web 38 to the ledge 39. The volute 36 is connected to the ledge 39 through wall 58.

Figure 3:
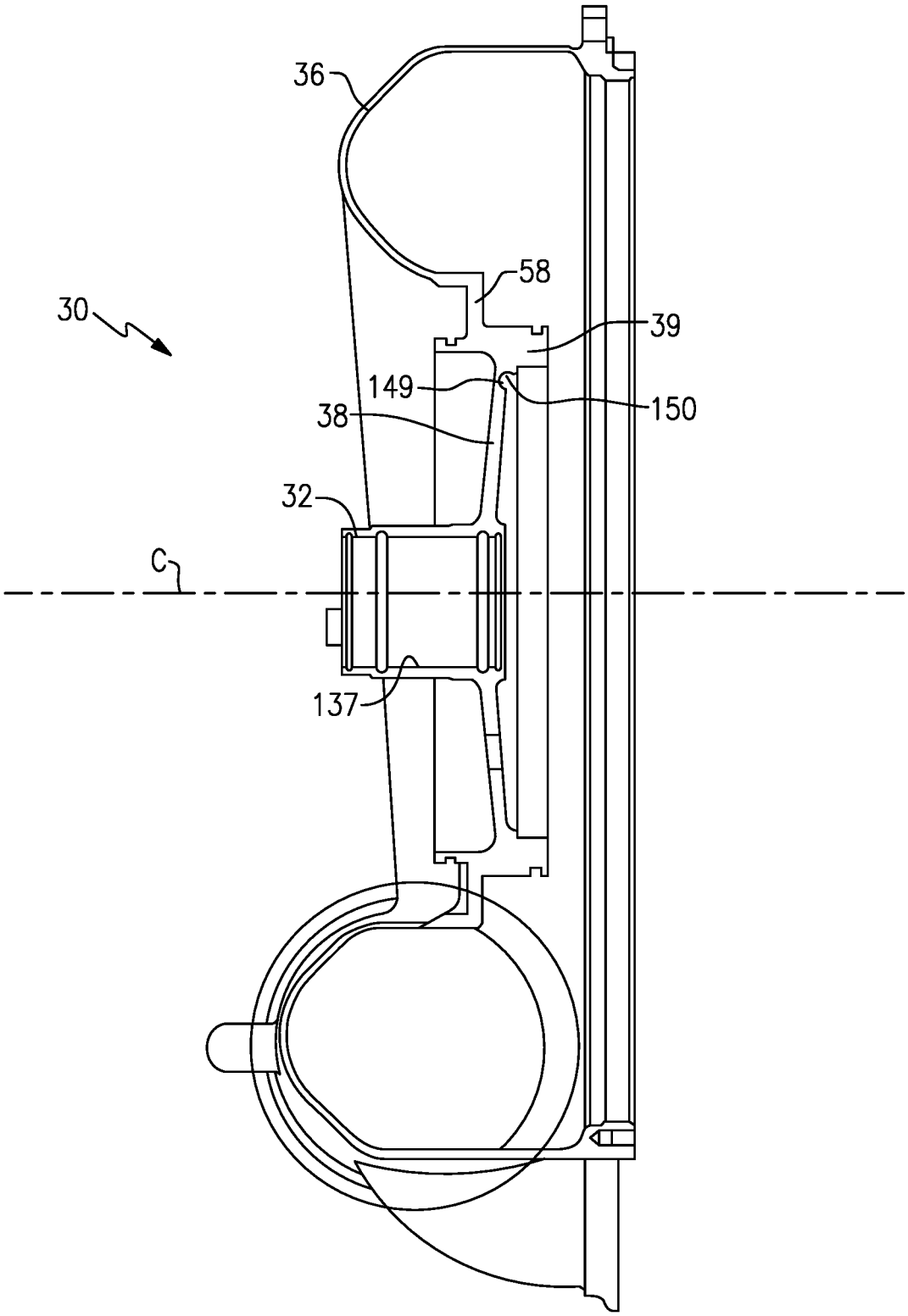
FIG. 3 is a view of a challenge with the compressor outlet housing.

FIG. 3 shows a cross-section through compressor housing 30. As can be seen, bearing support 32 defines a bore 137 to receive a bearing and is connected to the axially extending ledge 39 through the radially inwardly extending web 38. The fillet 149 could see damage such as erosion damage 150. This may be due to the air flow X shown in FIG. 1B. This is, of course, undesirable.

Figure 4:
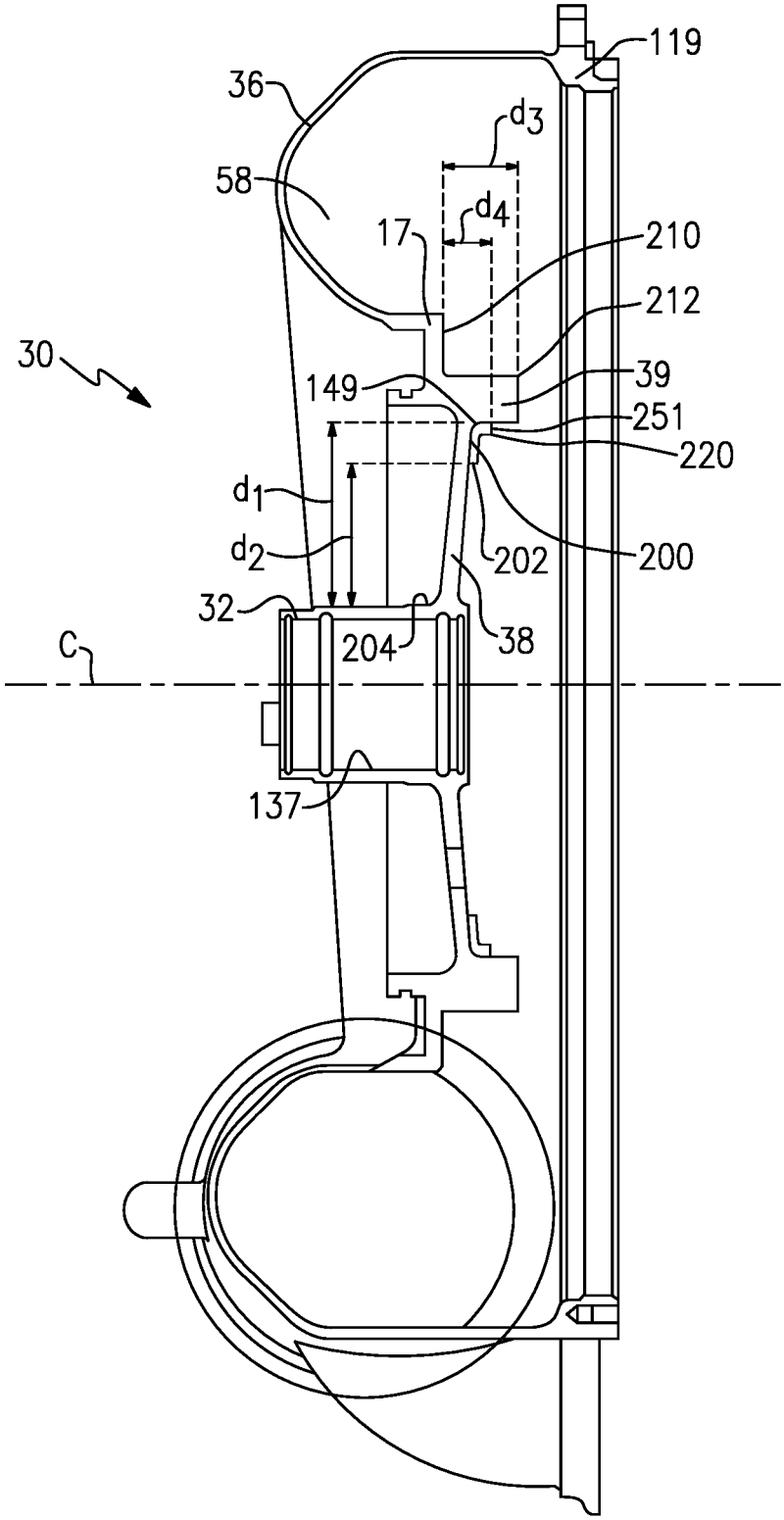
FIG. 4 shows an inventive compressor outlet housing.

FIG. 4 shows details of compressor outlet housing 30. A body 119 of housing 30 has a web 38 that connects bearing support 32 to ledge 39. An erosion resistant coating 200 is formed at the fillet 149. The coating 200 extends from an axially forward end 220 to a spaced radially inner end 202.

As shown, the coating does not need to coat the entirety of the ledge 39 nor the web 38. Instead, the coating is only over a portion of the ledge and web. In an embodiment, a radial distance $d_1$ can be defined perpendicular to a central axis C of the bearing support 32, from an outer surface 204 of bearing support 32 to a radially inner end 251 of the ledge 39. A second distance $d_2$ is also defined perpendicular to the axis C from the surface 204 to the radially innermost end 202 of the coating 200.

Another distance $d_3$ is defined parallel to the axis C from a forward end 212 of the ledge 39 to a forward end 210 of the wall 58. Another distance $d_4$ is defined from the axially forward end 220 of the coating 200 to the same end 210 of the wall 58. In embodiments, a ratio of $d_1$ to $d_2$ is between 1.1 and 2.0. In embodiments, it may be greater than 1.16. In embodiments, a ratio of $d_3$ to $d_4$ is between 1.1 and 2.0. Of course the coating can extend over the entire surface in some embodiments.

It is beneficial that the coating is not provided across the entirety of the web or the ledge, as the coating may well provide erosion resistance benefits, but may also comprise strength and thus its use may be minimized.

The coating may be tungsten carbide, or a similar hard coating. As one example, a hard aluminum coating may be utilized in combination with the otherwise soft aluminum of the body 119. The coatings can be applied by d-gun, HVOF or some similar method. In addition, a hard anodized coating or similar hard coating may be applied by chemical methods.

A compressor outlet housing 30 under this disclosure could be said to include a housing body 119 having a volute 36 and a radially inwardly extending wall 58 extending from a radially inner surface 17 of the volute. The radially inwardly extending wall 58 extends inwardly to a ledge 39, a radially inwardly extending web 38 extends to a bearing support 32. A fillet 149 will face an impeller 22 when the compressor outlet housing is mounted in a compressor. The fillet connects the ledge 39 to the web 38, and an erosion resistant coating 200 is formed at least on the fillet.

A method of repairing a compressor for use in an aircraft under this disclosure could be said to include the steps of removing an existing compressor outlet housing from a compressor having a compressor impeller and a compressor inlet connected to supply air to the compressor impeller. The compressor inlet is to be connected to a source of RAM air on an aircraft. The compressor has an electric motor for driving the compressor impeller, and a shaft driven by the electric motor to rotate the compressor impeller. The compressor impeller includes seal teeth. The method further includes the steps of replacing the existing compressor outlet housing with a replacement compressor outlet housing. The replacement compressor outlet housing has a housing body having a volute and a radially inwardly extending wall extending from a radially inner surface of said volute. The radially inwardly extending wall extending inwardly to a ledge. A radially inwardly extending web extends to a bearing support. A fillet faces the compressor impeller. The fillet connects the ledge to the web. An erosion resistant coating being formed on the fillet.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A compressor outlet housing comprising:

a housing body having a volute and a radially inwardly extending wall extending from a radially inner surface of said volute, and said radially inwardly extending wall extending inwardly to a ledge, a radially inwardly extending web extending to a bearing support, and a fillet which will face an impeller when said compressor outlet housing is mounted in a compressor, said fillet connecting said ledge to said web, and an erosion resistant coating being formed at least on said fillet; and wherein a first radial distance is defined between a radially innermost surface of said ledge to a radially outermost surface of said bearing support, and measured perpendicular a central axis of said bearing support and a second radial distance is defined from a radially innermost end of said coating to said radially outermost surface of said bearing support also measured perpendicular to said central axis of said bearing support and a ratio of said first radial distance to said second radial distance is between 1.1 and 2.0.

2. The compressor outlet housing as set forth in claim 1, wherein said erosion resistant coating is harder than an aluminum material forming said housing body.

3. The compressor outlet housing as set forth in claim 2, wherein said erosion resistant coating is tungsten carbide.

4. The compressor outlet housing as set forth in claim 1, wherein a third axial distance is defined between an axially forward end of said ledge to an axially forward end of said wall and a fourth axial distance being defined from an axially forward end of said coating to said axially forward end of said ledge along a line parallel to said central axis, and said ratio of said third axial distance to said fourth axial distance is between 1.1 and 2.0.

5. A compressor for use in an aircraft comprising:

a compressor impeller and a compressor inlet connected to supply air to said compressor impeller, said compressor inlet to be connected to a source of RAM air on an aircraft;

an electric motor for driving said compressor impeller, and a shaft driven by said electric motor to rotate said compressor impeller, said compressor impeller including seal teeth;

a compressor outlet housing with a housing body having a volute and a radially inwardly extending wall extending from a radially inner surface of said volute, and said radially inwardly extending wall extending inwardly to a ledge, a radially inwardly extending web extending to a bearing support, and a fillet facing said compressor impeller, said fillet connecting said ledge to said web, and an erosion resistant coating being formed at least on said fillet; and wherein a first radial distance is defined between a radially innermost surface of said ledge to a radially outermost surface of said bearing support, and measured perpendicular to a central axis of said bearing support and a second radial distance is defined from a radially innermost end of said coaling to said radially outermost surface of said bearing support also measured perpendicular to said central axis of said bearing support and a ratio of said first radial distance to said second radial distance is between 1.1 and 2.0.

6. The compressor for use in an aircraft as set forth in claim 5, wherein said erosion resistant coating is harder than an aluminum material forming said housing body.

7. The compressor for use in an aircraft as set forth in claim 6, wherein said erosion resistant coating is tungsten carbide.

8. The compressor for use in an aircraft as set forth in claim 5, wherein an outlet of said compressor outlet housing being connected to supply air to a cabin on an aircraft.

9. The compressor for use in an aircraft as set forth in claim 5, wherein a third axial distance is defined between an axially forward end of said ledge to an axially forward end of said wall and a fourth axial distance being defined from an axially forward end of said coating to said axially forward end of said ledge measured along a line parallel to said central axis, and said ratio of said third axial distance to said fourth axial distance is between 1.1 and 2.0.

10. A method of repairing a compressor for use in an aircraft comprising the steps:

1) removing an existing compressor outlet housing from a compressor having a compressor impeller and a compressor inlet connected to supply air to said compressor impeller, said compressor inlet to be connected to a source of RAM air on an aircraft, an electric motor for driving said compressor impeller, and a shaft driven by said electric motor to rotate said compressor impeller, said compressor impeller including seal teeth; and 2) replacing the existing compressor outlet housing with a replacement compressor outlet housing, the replacement compressor outlet housing having a housing body with a volute and a radially inwardly extending wall extending from a radially inner surface of said volute, and said radially inwardly extending wall extending inwardly to a ledge, a radially inwardly extending web extending to a bearing support, and a fillet facing said compressor impeller, said fillet connecting said ledge to said web, and an erosion resistant coating being formed on said fillet; and wherein a first radial distance is defined between a radially innermost surface of said ledge to a radially outermost surface of said bearing support, and measured perpendicular to a central axis of said bearing support and a second radial distance is defined from a radially innermost end of said coating to said radially outermost surface of said bearing support also measured perpendicular to said central axis of said bearing support and a ratio of said first radial distance to said second radial distance is between 1.1 and 2.0.

11. The method of repairing a compressor for use in an aircraft as set forth in claim 10, wherein said erosion resistant coating is harder than an aluminum material forming said housing body.

12. The method of repairing a compressor for use in an aircraft as set forth in claim 11, wherein said erosion resistant coating is tungsten carbide.

13. The method of repairing a compressor for use in an aircraft as set forth in claim 10, wherein a third axial distance is defined between an axially forward end of said ledge to an axially forward end of said wall and a fourth axial distance being defined from an axially forward end of said coating to said axially forward end of said ledge measured along a line parallel to said central axis, and said ratio of said third axial distance to said fourth axial distance is between 1.1 and 2.0.

* * * * *